US005672053A

United States Patent [19]

Sabha

[11] Patent Number: 5,672,053

[45] Date of Patent: Sep. 30, 1997

[54] COMPRESSOR REED VALVE WITH VALVE PLATE CHANNEL

[75] Inventor: Nick George Sabha, Youngstown, N.Y.

[73] Assignee: General Motors Corporation, Detroit, Mich.

[21] Appl. No.: 416,123

[22] Filed: Apr. 3, 1995

[51] Int. Cl.[6] ..... F04B 53/10

[52] U.S. Cl. ..... 417/569; 137/855

[58] Field of Search ..... 417/269, 569, 417/571; 137/855

[56] References Cited

U.S. PATENT DOCUMENTS

| | | | |
|---|---|---|---|
| 4,976,284 | 12/1990 | Hovarter . | |
| 4,978,285 | 12/1990 | Da Costa | 417/569 |
| 5,062,779 | 11/1991 | Da Costa | 137/855 |

FOREIGN PATENT DOCUMENTS

| | | | |
|---|---|---|---|
| 211076 | 12/1983 | Japan | 137/855 |
| 6002654 | 1/1994 | Japan | 417/269 |
| 1040214 | 9/1983 | U.S.S.R. | 137/855 |

*Primary Examiner*—Richard A. Bertsch
*Assistant Examiner*—Roland G. McAndrews, Jr.
*Attorney, Agent, or Firm*—Patrick M. Griffin

[57] ABSTRACT

An improved reed type compressor discharge valve assembly uses a conventional reed and reed stop, but increases flow efficiency past the reed with a uniquely configured valve plate. The valve plate has a round discharge port of conventional size and diameter, but the surface of the valve plate beneath the reed is formed with a recessed channel that opens into the near edge of the port. This provides a more open and less restricted flow path out of the port, and creates an effectively greater opening height for the reed.

3 Claims, 4 Drawing Sheets

COMPRESSOR REED VALVE WITH VALVE PLATE CHANNEL

This invention relates to automotive air conditioner compressors in general, and specifically to a valve assembly for such a compressor that increases the flow efficiency.

BACKGROUND OF THE INVENTION

Automotive air conditioning compressors are typically piston machines, in which reciprocating pistons within cylinder bores pull in refrigerant from a low pressure cavity on the back stroke, and drive it out to a high pressure cavity on the up stroke. Reverse flow into the cylinders is prevented by one way valve assemblies, referred to as suction or discharge valves, depending on their use. Most often, the valve assembly is a thin, resilient, elongated reed that is either riveted to the flat surface of a thicker, disk-shaped valve, or which is lanced integrally out of a thin metal sheet. The valve plate separates the cylinder bores from the various refrigerant cavities. The front of the reed covers a refrigerant port through the plate, while the back end of the reed acts as a hinge. The reed bends up about the hinge, away from the surface of the plate, to allow flow across the port in only the desired direction, and snaps back down against the valve plate to prevent reverse flow. In this way, the assembly of reed and valve plate maintains the desired pressure differentials in a simple, passively responsive fashion.

While simple, the typical reed valve assembly does have some inherent limitations. Since the metal reed snaps up and down against the metal valve plate, it can cause noise. The reed also requires a metal stop to limit its upward bending, contact with which can cause noise. Since the reed bends with every piston stroke, it is stressed accordingly, to a degree that roughly corresponds to the height that it lifts from the surface of the valve plate while opening. The reed lift height must be great enough that flow across the port, which must pass around the sides of the reed, is not limited. In order to create enough reed lift height away from the valve plate, a minimal reed length is necessary, since a short reed will be inherently stiff. Moreover, the lift height varies along the length of the reed, being greatest at the front end, and less toward the back. Since the port has a finite diameter, the reed does not lift away from the port by a constant height, and flow will be more restricted through that area of the port that is closest to the hinge point. This requires that the lift height at the front of the reed be greater than it would have to be if the reed lifted away from the plate uniformly. And, again, greater reed lift height is also associated with noise and reed stress. If flow is too limited by the valve, especially in the case of a discharge valve, an excessive so called overshoot pressure can occur, meaning the degree to which pressure in front of the piston exceeds the elevated pressure created in the compressor discharge cavity. Overshoot pressure is a good measure of excess, wasted work done by the compressor, and is also the cause of compressor vibration, shaking and noise, which can be a greater problem than inherent reed noise.

Little attention has been paid to the reed valve assembly per se, since they do function well enough, and reed noise can be muffled or simply tolerated, while compressor vibration can be dampened and resisted with a robust and cushioned compressor mount. One co-assigned U.S. Pat. No. 4,976,284, does disclose a novel reed design, used as a suction valve, in which the otherwise unused length of the reed is itself pierced by an oblong hole, but only in the area of the reed that does not directly cover the port in the valve plate. Therefore, when the reed is closed, the valve plate port is completely blocked by the reed. When the reed opens, however, the oblong hole does not allow flow through it, in addition to flow around the sides of the reed. Reed lift height can therefore be reduced somewhat, while still allowing sufficient flow through the port, with consequent reduction in reed stress and noise.

SUMMARY OF THE INVENTION

The invention provides an alternative to the valve assembly described above in which the reed is unaltered, but the shape of the valve plate near the port is altered to increase both the flow efficiency height and the effective valve lift height.

In the embodiment disclosed, the valve assembly is a discharge valve, although the basic design could serve as either. The reed and its stop are conventional in shape and structure, and are riveted to the flat surface of a valve plate over a circular discharge port. The surface of the valve plate between the port and the back end of the reed are significantly altered, however. A channel is recessed into the valve plate surface which is roughly coextensive with the area of overlap between the reed and the valve plate. The channel is gently rounded, and both widens and deepens as it blends into the near edge of the circular port. The distance between the bottom of the channel and the overlaying reed is greater than the distance between the reed and the flat surface of the valve plate. The effective valve opening height is therefore greater, at least under that part of the reed where the channel blends into the inboard edge of the port. Moreover, refrigerant flow through the port can also flow into and along the length of the channel, which reduces resistance and increases flow through the port. Piston overshoot pressure, and the consequent vibration and noise, is significantly reduced.

DESCRIPTION OF THE PREFERRED EMBODIMENT

These and other features of the invention will appear from the following written description, and from the drawings, in which.

Figure 1:
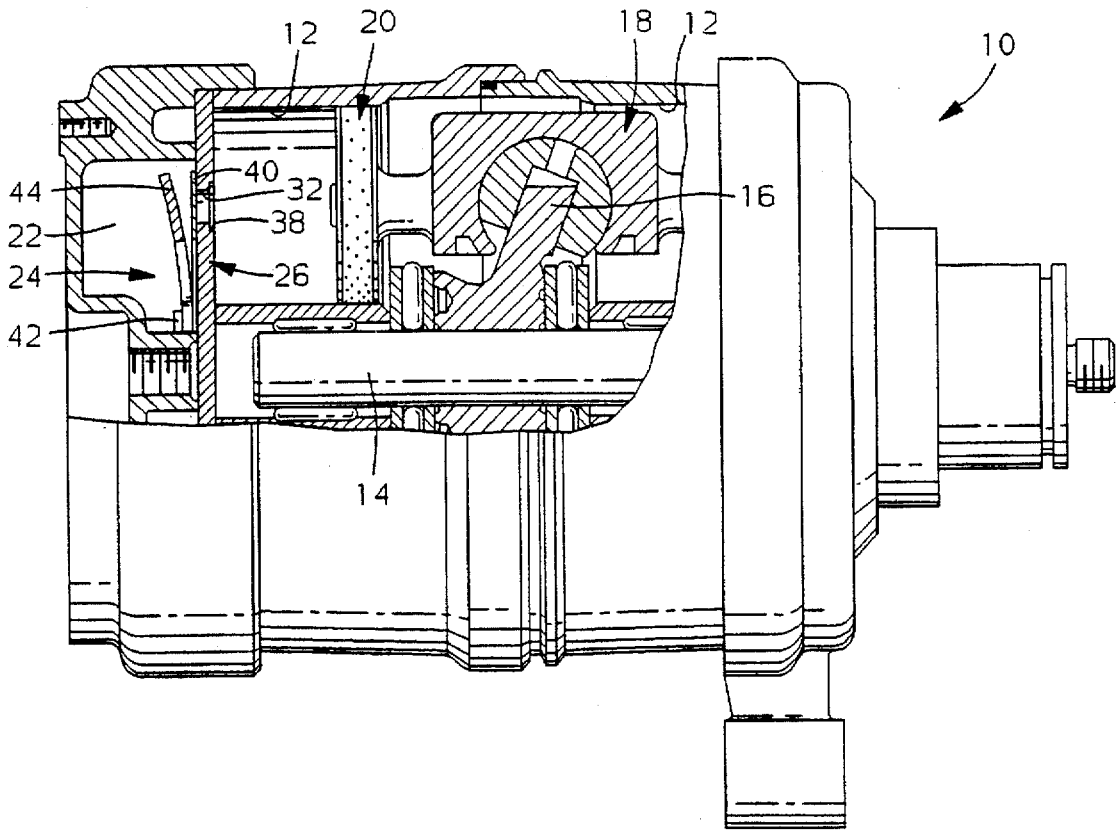
FIG. 1 is a compressor partially sectioned to show one cylinder bore and one discharge valve assembly in a closed position.

Referring first to FIG. 1, an automotive air conditioning system compressor, indicated generally at 10, has a series of six evenly spaced cylinder bores 12 surrounding a central drive shaft 14. A swashplate 16 reciprocates a series of three two headed pistons, indicated generally at 18, each of which has one head 20 movable within a respective bore 12. Each piston 18 sequentially draws in low pressure refrigerant and expels it under pressure. A suitable suction valve, not illustrated in detail, admits low pressure refrigerant to the cylinder bore 12, in front of piston head 20, when piston 18 is in the retracted position shown. In the compressor 10 disclosed, the suction valve would be the type that is affixed directly to the piston head 20, and which draws low pressure refrigerant in from behind the piston 18 on the backstroke. In another embodiment, the suction valve could be of the same general type as disclosed in the co-assigned patent discussed above. On the upstroke, piston head 20 compresses and drives the refrigerant in bore 12 into a high pressure discharge cavity 22, from which it eventually is sent to a condenser. Separating the discharge cavity 22 from each cylinder bore 12, and maintaining the pressure differential between them by preventing reverse flow, is the valve assembly of the invention, indicated generally at 24.

Figure 2:
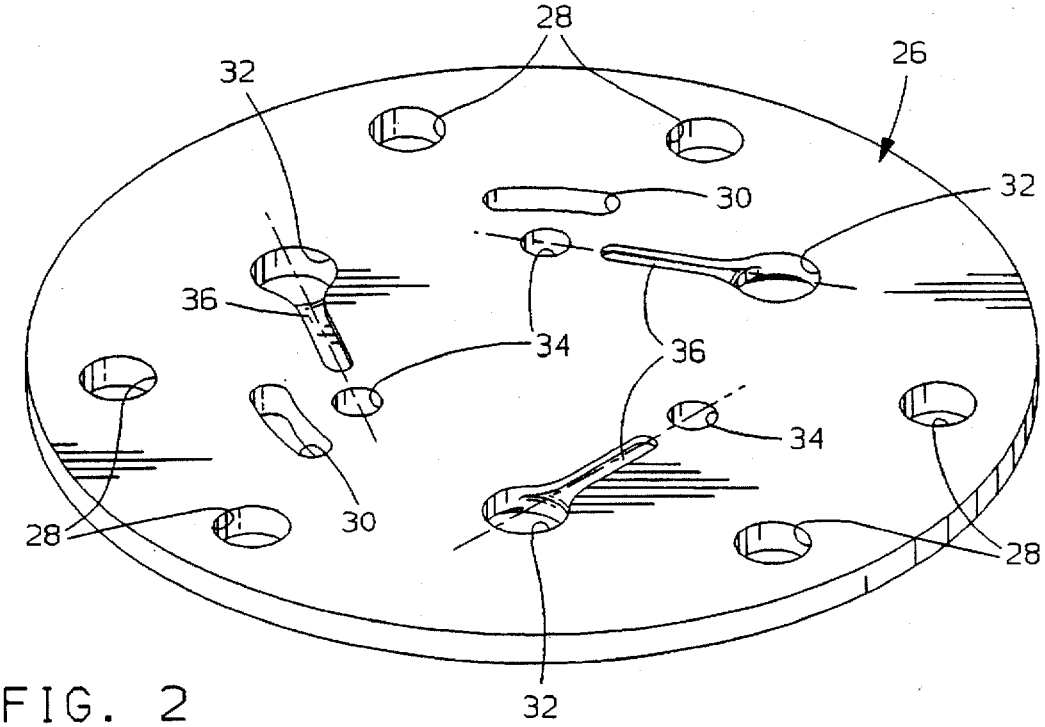
FIG. 2 is a perspective view of the valve plate alone.
Figure 5:
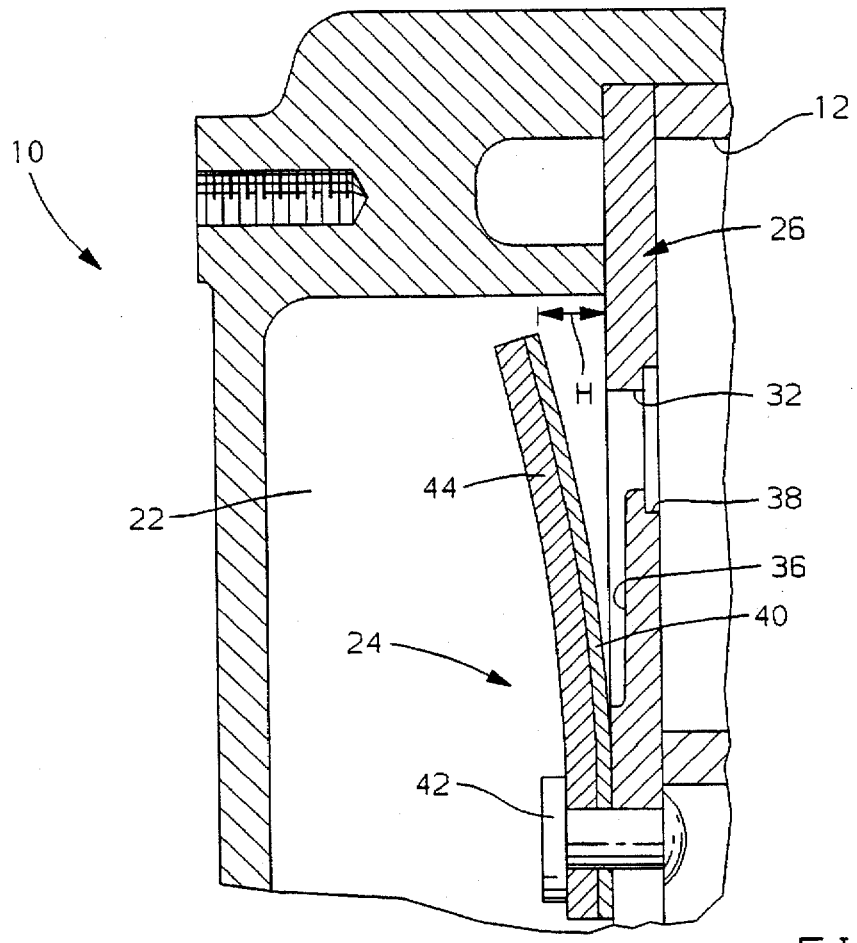
FIG. 5 is a cross section taken through the plane represented by the line 5—5 in FIG. 4.

Referring next to FIGS. 2 and 5, the foundation of valve assembly 24 is a disk-shaped valve plate 26. Valve plate 26 is a robust steel plate, approximately 3 mm thick, almost as large in diameter as the compressor 10 itself, and machined smooth and flat on both sides. Several voids and holes in plate 26 serve various functions. Six simple round holes 28 provide clearance for non-illustrated bolts, which clamp the various components of compressor 10 together. Two oblong slots 30 provide discharge cross over passages which form part of the complex internal refrigerant gas circuit typical of compressor designs incorporating two headed pistons. Most significant to the invention, three evenly spaced round discharge ports 32 are cut through plate 26, each of which is offset from a smaller round rivet hole 34. Dotted lines drawn through the centers of each port 32-rivet hole 34 pair define the central axis of a channel 36, which is recessed below the flat surface of plate 26, but which does not cut all the way through, comprising only about 25 percent of the thickness of plate 26 on average. Each channel 36 extends from a point near a respective rivet hole 34 as far as the proximate, inboard edge of a respective port 32. When plate 26 is manufactured, channel 36 is die stamped into it, with the excess, plowed up material being machined off flat when the surface of plate 26 is machined flat later. Channel 36 increases in depth as it approaches the proximate edge of its respective port 32, blending thereinto across a rounded corner. Channel 36 is fairly uniform in width along most of its length, but widens just as it blends into the edge of the port 32. The bottom of channel 36, as seen in a cross section normal to its length axis, is gently rounded. Finally, the opposite flat surface of plate 26 is chamfered at 38 to a slight depth surrounding each port 32.

Figure 3:
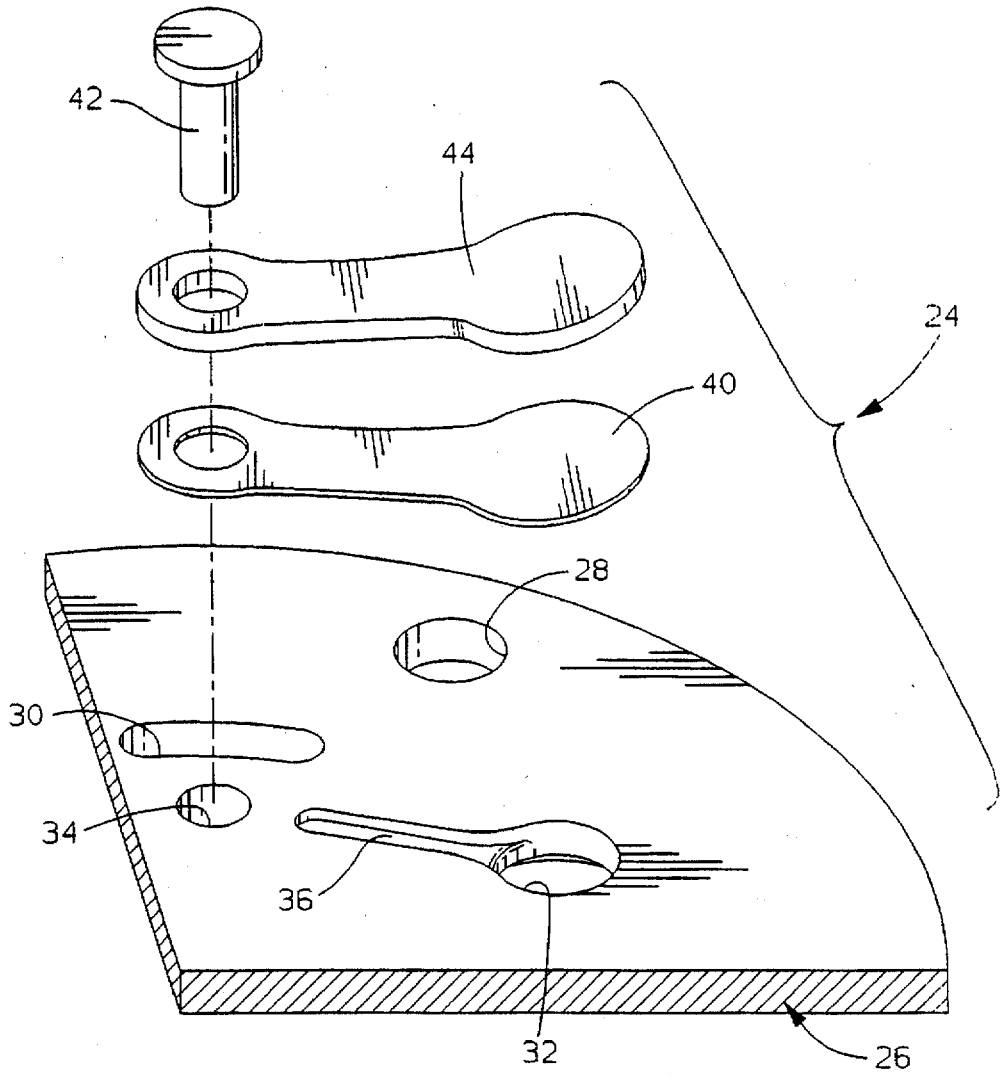
FIG. 3 is a section of the valve plate with the reed and stop disassembled.

Referring next to FIGS. 1 and 3, the other components of valve assembly 24 are a reed 40, rivet 42, and reed stop 44, one set for each port 32. Each reed 40 is a thin spring steel member, long enough to extend from a rivet hole 34 far enough to cover port 32. Reed 40 is widened at the front end to match port 32, while its width elsewhere is slightly greater than the width of a channel 36, sufficient to cover and seal it. The back end of each reed 40 is fixed firmly by rivet 42 through a rivet hole 34 so as to overlay both a channel 36 and port 32. Rivet 42 thereafter provides the hinge point about which reed 40 bends. Reed stop 44, which is sandwiched above reed 40 by the same rivet 42, sits permanently above reed 40. Reed 40 itself is flat in a free, unstressed state, and lies flush to the surface of plate 26 in its closed condition, as shown in FIG. 1.

Figure 4:
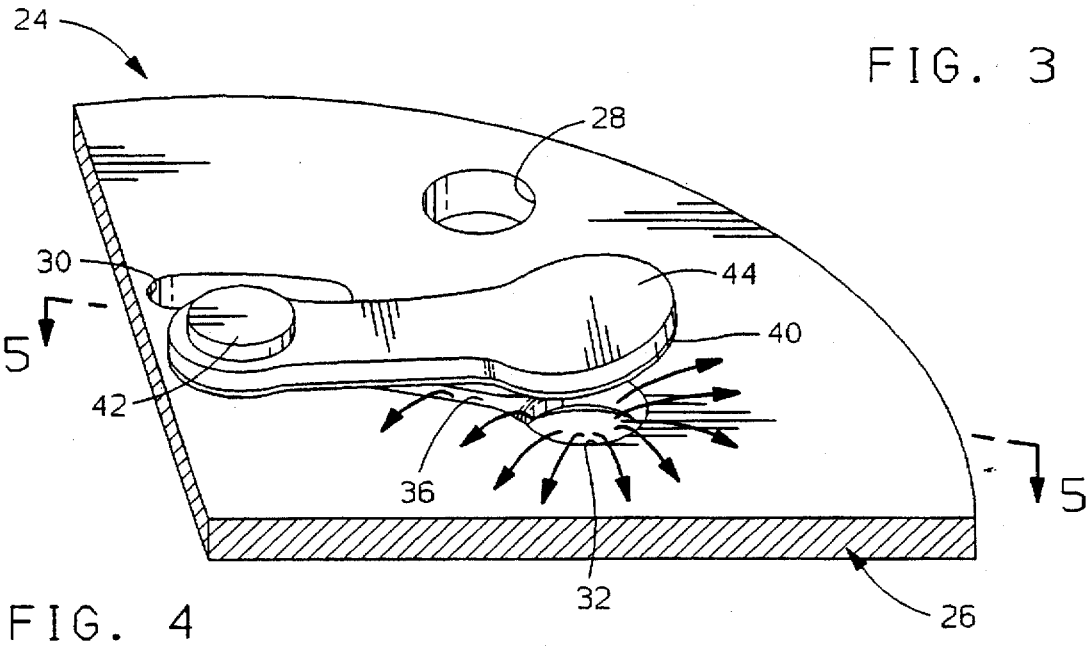
FIG. 4 is a view like FIG. 3, but showing the reed and stop attached to the plate, and in an open position.

Referring next to FIGS. 1, 4 and 5, the operation of valve assembly 24 is illustrated. Plate 26 is clamped into compressor 10 when it is bolted together, separating the cylinder bores 12 from the discharge cavity 22, oriented so that a port 32 is aligned with each cylinder bore 12. Reed 40 is located on the high pressure side of plate 26. Obviously, there would be two such assemblies 24, since the cylinders 18 are two sided, but only one is shown in FIG. 1. On the backstroke of piston 18, the high pressure refrigerant in discharge cavity 22 cannot reverse flow into the cylinder bore 12, because the free state condition of reed 40 is flat to the surface of plate 26, covering and blocking all of port 32 and channel 36, a condition that is assisted by the high pressure in cavity 22. Low pressure refrigerant would flow in, however. On the upstroke, as seen in FIGS. 4 and 5, reed 40 is pushed outwardly, bending up and away from the surface of valve plate 26 about the rivet 42 in cantilever fashion, to an angle limited by stop 44. Both the port 32 and channel 36 are uncovered. Refrigerant is expelled forcefully through the port 32, which is much smaller in size than the cylinder bore 12, causing the expelled gas to be highly pressurized by the rapidly moving piston head 20. As shown by the flow arrows in FIG. 4, the opening of channel 36 into the near edge of port 32 acts analogously to a drainage trench cut out and away from the edge of a circular pond. Channel 36 creates a more open, less restricted flow path for compressed discharge refrigerant, which can flow with reduced resistance down the length of the channel 36 and then up around the side of the reed 40 into cavity 22. The front end of reed 40 lifts to the greatest height H, as measured from the flat surface of plate 26. Between the inboard edge of port 32 and the rivet 42, the lift height of the reed 40 steadily decreases, but is effectively increased relative to what it would be for a conventional reed vale assembly by virtue of the deliberate recession of the surface of plate 26 beneath the reed 40. There is more room created for the refrigerant that flows down the channel 36 to escape between the underside of the reed 40 and the surface of plate 26. The increased flow created by the channel 36 can be best seen by comparison to the prior art valve assembly, described next.

Figure 6:
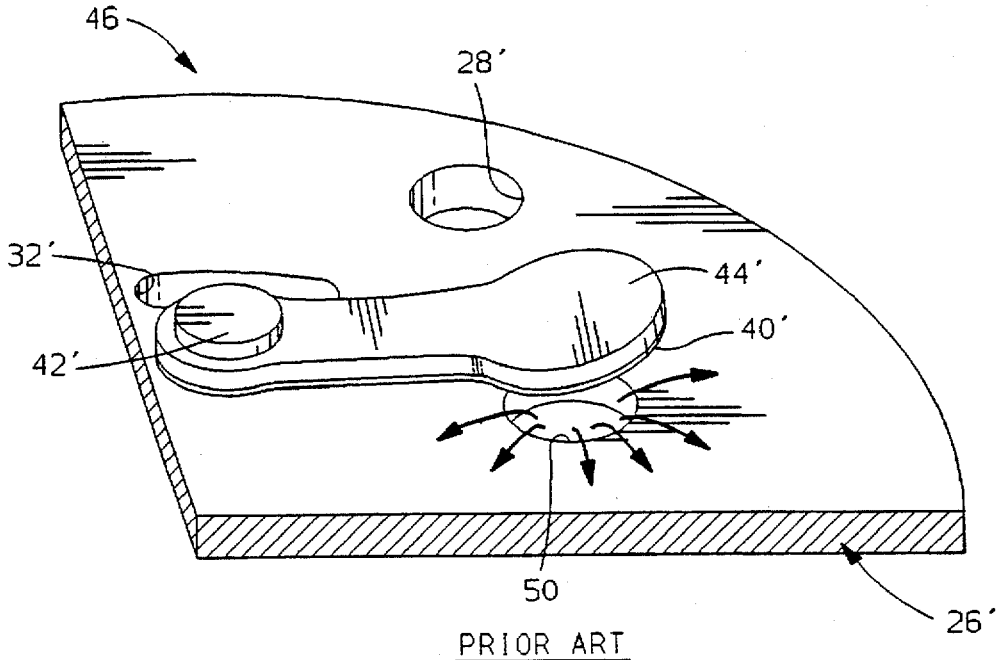
PRIOR ART FIG. 6
FIG. 6 is a view of a prior art valve corresponding to FIG. 4.
Figure 7:
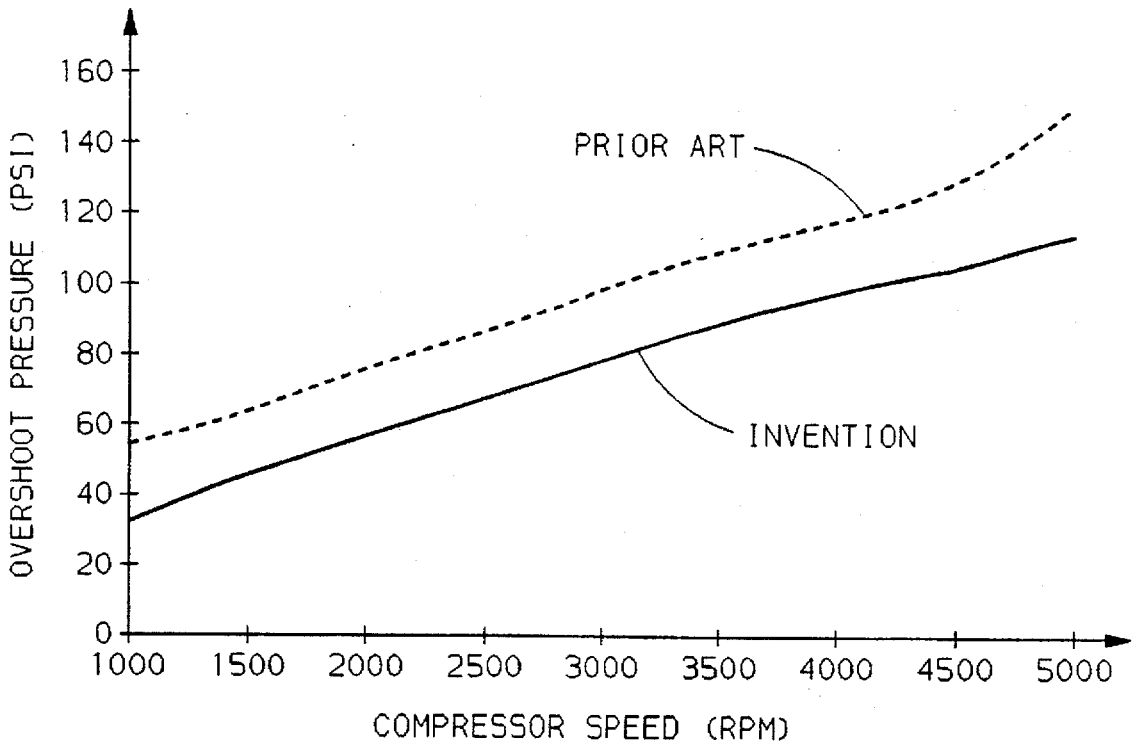
FIG. 7 is a graph comparing the overshoot pressures of valve assemblies made according to the invention and the prior art.

Referring next to FIGS. 6 and 7, a conventional valve assembly, indicated generally at 46, has the same reed, rivet and stop, indicated by the same numbers primed. The valve plate is the same size and thickness, as well, indicated at 26'. The discharge port 50 through plate 26', however, is a simple round hole, and the low therethrough is limited to just the area enclosed by the circular perimeter edge. The area of plate 26' overlain by the reed 40' between the port 50 and the rivet 42' is not utilized. As shown in FIG. 7, the more efficient outflow allowed by the invention leads to a significantly lower overshoot pressure across a wide compressor speed range. Again, overshoot pressure is the degree to which pressure within the cylinder bore 12 exceeds the pressure in the discharge cavity 22, and represents wasted compressor work. Overshoot pressure manifests itself in vibration and noise, which is also significantly reduced for the valve assembly 24 of the invention. In addition, it would be possible to lower the total reed lift height H, and still reduce overshoot pressure. Lower reed lift height also acts to reduce noise and reed stress, although the primary benefit is a consequence of the reduced overshoot pressure.

The increased efficiency of the valve assembly 24 of the invention is achieved at very little expense, since the reed 40 and stop 44 are essentially unchanged, and the channel 36 can be formed in the same operation that punches the other holes and slots through plate 26. As noted, the same feature could be incorporated in a suction reed valve, if desired. Working within the general framework of a flow increasing channel that opens into the near edge of a circular port, and which occupies the otherwise unutilized plate area beneath the reed, a designer could experiment with varying widths, depths, and bottom shapes for the channel, so long as the reed was capable of covering it completely when closed. It is thought that both the deepening of and widening of the channel 36 where it intersects with the port 32 help make the outflow of refrigerant smoother and more efficient. The reed need not be a separate member riveted to the plate, but could instead be lanced integrally from a larger metal sheet, and which would bend about an integral, live hinge point. Therefore, it will be understood that it is not intended to limit the invention to just the embodiment disclosed.

The embodiment of the invention in which an exclusive property or privilege is claimed are defined as follows:

1. In a refrigerant compressor having a piston and cylinder bore separated from a refrigerant cavity by a valve plate having a port therethrough and with a pressure differential existing across said valve plate, and in which reverse flow across said port is prevented by an elongated, cantilevered reed valve element located on cavity side of said valve plate that passively opens and closes said port by bending resiliently away from a surface of said valve plate and back about a hinge point that is offset from said port, the improvement comprising, a channel recessed below the surface of said valve plate and extending from said port toward said reed valve hinge point, generally coextensive with said reed valve element, and intersecting the edge of said port, whereby the resistance to flow across said port is reduced and the effective opening height of said reed valve element is effectively increased, creating a more efficient flow through said port.

2. A refrigerant compressor according to claim 1 in which said refrigerant cavity is a discharge cavity.

3. A refrigerant compressor according to claim 1 in which a width and depth of said channel increase at the intersection with said port.

* * * * *